US010588422B2

(12) United States Patent
Torres

(10) Patent No.: US 10,588,422 B2
(45) Date of Patent: Mar. 17, 2020

(54) FOLDABLE BABY CHAIR

(71) Applicant: KiddieGo, LLC, Crofton, MD (US)

(72) Inventor: Emma Torres, Crofton, MD (US)

(73) Assignee: KiddieGo, LLC, Crofton, MD (US)

( * ) Notice: Subject to any disclaimer, the term of this patent is extended or adjusted under 35 U.S.C. 154(b) by 77 days.

(21) Appl. No.: 15/822,067

(22) Filed: Nov. 24, 2017

(65) Prior Publication Data

US 2018/0146794 A1 May 31, 2018

Related U.S. Application Data

(60) Provisional application No. 62/426,472, filed on Nov. 26, 2016.

(51) Int. Cl.
*A47D 1/02* (2006.01)
*A47D 15/00* (2006.01)

(52) U.S. Cl.
CPC ..... *A47D 1/02* (2013.01); *A47D 15/006* (2013.01)

(58) Field of Classification Search
CPC ..... A47D 1/023
USPC ..... 297/255
See application file for complete search history.

(56) References Cited

U.S. PATENT DOCUMENTS 5,395,154 A * 3/1995 Wang ..... A47D 1/02 280/30
5,499,860 A * 3/1996 Smith ..... A47D 1/02 297/183.5
2003/0067198 A1* 4/2003 Treen ..... A47D 1/002 297/250.1
2004/0021353 A1* 2/2004 Lozano ..... A45C 13/00 297/255
2018/0279804 A1* 10/2018 Romero ..... A47D 15/006

* cited by examiner

*Primary Examiner* — Joanne Silbermann
(74) *Attorney, Agent, or Firm* — Rahman LLC

(57) ABSTRACT

A foldable baby chair including a bottom portion, a back portion, and a hinged joint connecting the bottom portion to the back portion, wherein the bottom portion and the back portion include a substantially similar and substantially rectangular shape and size, and wherein the hinged joint is to allow the back portion to be configured in different pre-defined positions in relation to the bottom portion, the predefined positions including at least one of a position substantially at 90° to the bottom portion to be configured in a upright chair position, a position wherein the back portion is substantially parallel to the bottom portion, and a position wherein the back portion is substantially 180° and planar to the bottom portion. The baby chair may further include a set of foldable legs fixed to the bottom portion, wherein the set of foldable legs include any of plastic and aluminum.

20 Claims, 11 Drawing Sheets

FOLDABLE BABY CHAIR

CROSS-REFERENCE TO RELATED APPLICATIONS

This application claims priority to U.S. Provisional Application Ser. No. 62/426,472, filed on Nov. 26, 2016, the complete disclosure of which, in its entirety, is hereby incorporated by reference.

BACKGROUND

Technical Field

The embodiments herein generally relate to baby chairs, and more particularly to a baby chair that may be folded.

Description of the Related Art

A variety of baby chairs are available in the market. However, most of these suffer from various deficiencies. For example, most are not readily portable and may be too heavy to be carried conveniently. Moreover, they may consume too much space when traveling or during storage. They may also offer limited utilities, and still may be quite expensive.

SUMMARY

In view of the foregoing, the embodiments herein provide a multi-purpose folding baby chair that may be used both as a chair and as a changing station. It may be folded for easy portability and substitute for a diaper bag, and is user-friendly, inexpensive to manufacture, and affordable to customers. Moreover, the baby chair is safe for babies and offers attachments for keep a baby entertained.

An embodiment provides a foldable baby chair comprising a bottom portion; a back portion; and a hinged joint connecting the bottom portion to the back portion, wherein the bottom portion and the back portion comprise a substantially similar and substantially rectangular shape and size, and wherein the hinged joint is to allow the back portion to be configured in different pre-defined positions in relation to the bottom portion, the predefined positions comprising at least one of a position substantially at 90° to the bottom portion to be configured in a upright chair position, a position wherein the back portion is substantially parallel to the bottom portion, and a position wherein the back portion is substantially 180° and planar to the bottom portion. The baby chair may further comprise a set of foldable legs fixed to the bottom portion, wherein the set of foldable legs comprise any of plastic and aluminum.

The baby chair may further comprise upholstery material covering the bottom portion and the back portion, wherein the bottom portion and the back portion are cushioned. The baby chair may further comprise at least one interior storage compartment on a backside of the back portion, wherein the at least one interior storage compartment is configured within the upholstery material covering the back portion. In another embodiment, the baby chair may further comprise at least two interior storage compartments on a backside of the back portion, wherein the at least two interior storage compartments are configured within the upholstery material covering the back portion. The baby chair may further comprise at least one exterior storage compartment on a backside of the bottom portion and the back portion, wherein the at least one exterior storage compartment is configured over the upholstery material covering the bottom portion and the back portion. The baby chair may further comprise a detachable cover over the upholstery material. The baby chair may further comprise a carrying handle attached to the back portion. The baby chair may further comprise an adjustable strap attached to the back portion. The baby chair may further comprise a safety harness attached to any of the bottom portion and the back portion, wherein the safety harness comprises any of an adjustable lap strap and an adjustable five-point harness. The baby chair may further comprise an accessory attachment strap coupled to the bottom portion; and a connection mechanism operatively connected to the accessory attachment strap.

Another embodiment provides a foldable baby chair comprising a bottom portion; a back portion; a hinged joint connecting the bottom portion to the back portion; a pair of identical folding hinges comprising a left-side hinge and a right-side hinge, each of the folding hinges comprising a pair of tubular arms, which may be aluminum; a set of four identical tubes securely fixed to the pair of tubular arms of the pair of identical folding hinges; a pair of plastic frames, wherein one of the plastic frames is fitted on two of the tubes fixed to the tubular arms to form a support structure for the bottom portion, and the second fitted on the remaining two tubes fixed to the other two tubular arms to form the back portion; and a cushion fixed on the pair of plastic frames. The baby chair may further comprise a set of foldable legs fixed to the bottom portion, wherein the set of foldable legs comprise any of plastic and aluminum. The baby chair may further comprise upholstery material covering the bottom portion and the back portion.

The baby chair may further comprise at least one interior storage compartment on a backside of the back portion, wherein the at least one interior storage compartment is configured within the upholstery material covering the back portion. In another embodiment, the baby chair may further comprise at least two interior storage compartments on a backside of the back portion, wherein the at least two interior storage compartments are configured within the upholstery material covering the back portion. The baby chair may further comprise at least one exterior storage compartment on a backside of the bottom portion and the back portion, wherein the at least one exterior storage compartment is configured over the upholstery material covering the bottom portion and the back portion. The baby chair may further comprise a detachable cover over the upholstery material. The baby chair may further comprise a carrying handle attached to the back portion. The baby chair may further comprise an adjustable strap attached to the back portion. The baby chair may further comprise a safety harness attached to any of the bottom portion and the back portion, wherein the safety harness comprises any of an adjustable lap strap and an adjustable five-point harness. The baby chair may further comprise an accessory attachment strap coupled to the bottom portion; and a connection mechanism operatively connected to the accessory attachment strap.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1A:
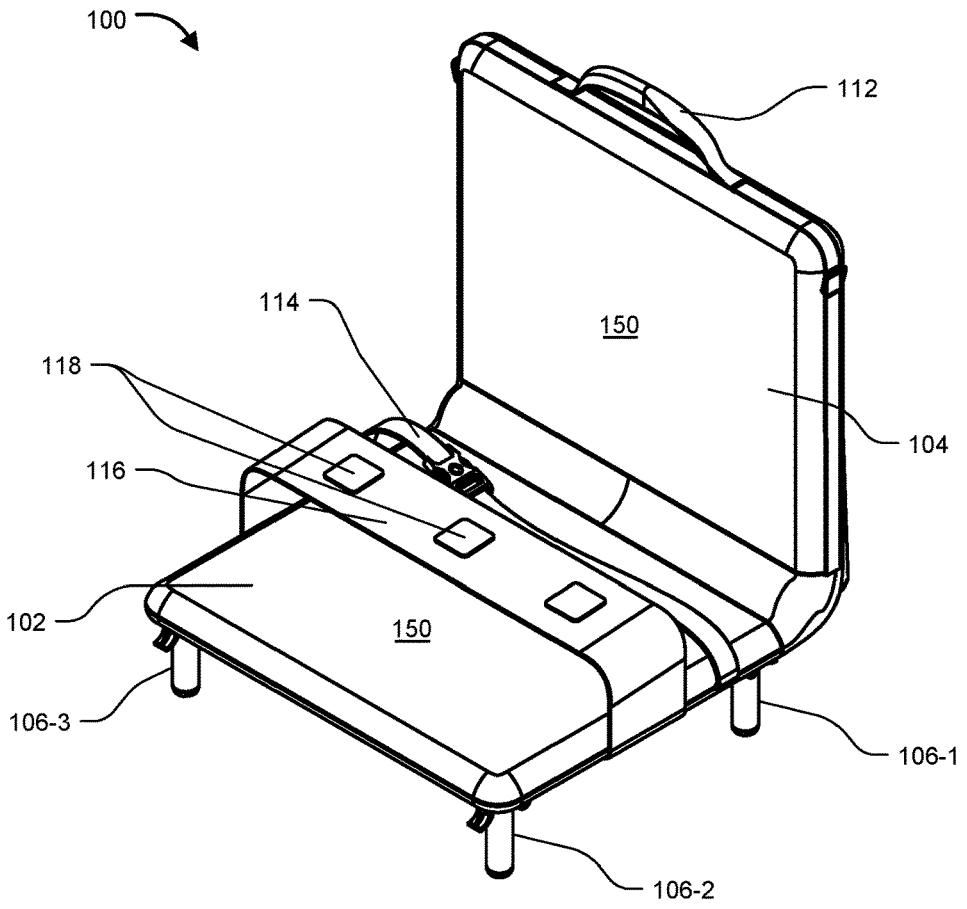
FIG. 1A is a perspective view of a baby chair, according to the embodiments herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide a folding baby chair that articulates into various configurations such as an upright baby chair and in a flat changing station configuration. Referring now to the drawings, and more particularly to FIGS. 1A through 6, where similar reference characters denote corresponding features consistently throughout the figures, there are shown preferred embodiments.

Referring to FIGS. 1A through 1D, the baby chair 100 comprises a bottom portion 102 and a back portion 104, the bottom portion 102 and the back portion 104 being of generally similar rectangular shape and size and coupled to each other at one side through a hinged joint 302-1, 302-2 (shown in FIGS. 3A through 3D), according to a first embodiment. The hinged joint 302-1, 302-2 allows the back portion 104 to articulate into different pre-defined positions in relation to the bottom portion 102. Specifically, the hinged joint **302-*a*1, 302-2 may allow the back portion 104 to be folded over the bottom portion 102 to enable the baby chair 100** to become compact and carried conveniently.

In an embodiment, the baby chair 100 may incorporate a set of foldable legs such as legs 106-1, 106-2, 106-3 and 106-4 (collectively referred to as legs 106) fixed the four respective corners of the lower side of the bottom portion 102. During use of the baby chair 100 as a chair, the set of legs 106 may be unfolded to a position that makes them perpendicular to lower/back side of the bottom portion 102 as shown in FIGS. 1A through 1D; and folded to a position along lower/back side of the bottom portion 102 (refer to FIGS. 4B and 4C), while the baby chair 100 is being carried in a compact manner. Preferably, the legs 106 are lightweight comprising any of plastic tubing and aluminum tubing.

In an embodiment, the baby chair 100 further includes one or more exterior storage compartments 108, 110 on backsides of the bottom portion 102 and the back portion 104 to store various items therein. These exterior storage compartments 108, 110 may be attached over upholstery 150 covering the chair 100 as shown in FIGS. 1B through 1D. Additionally, there may be storage compartments/pockets that are formed within the upholstery 150 covering the bottom portion 102 and the back portion 104 of the baby chair 100.

In an embodiment, the baby chair 100 further includes a carrying handle 112 attached to top side of the back portion 104 to enable carrying the baby chair 100 after the back portion 104 has been folded over the bottom portion 102, and when the legs 106 have been folded, then the baby chair 100 has a very compact configuration.

In an embodiment, the baby chair 100 further includes a two-point safety harness 114 to hold a baby in safe configuration when the baby chair 100 is being used as a chair; and an accessory attachment strap 116 attached to the bottom portion 102 to attach toys, etc. 502 (shown in FIG. 5A) wherein the toys, etc. 502 may be attached to the accessory attachment strap 116 through a connection mechanism 118 such as a Velcro® fastener, for example, fixed on the accessory attachment strap 116.

Figure 1B:
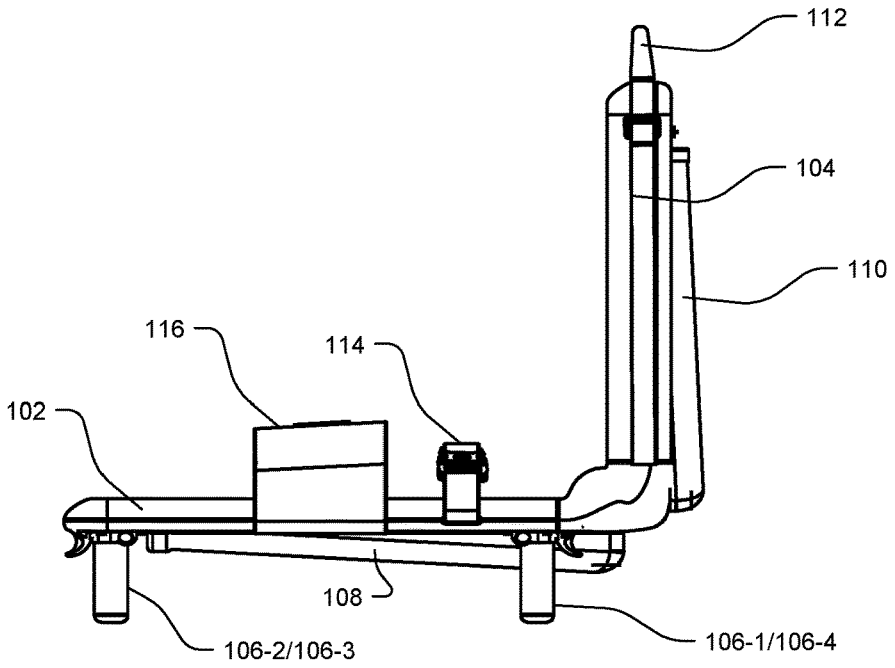
FIG. 1B is a side view of the baby chair of FIG. 1A, according to the embodiments herein.
Figure 1C:
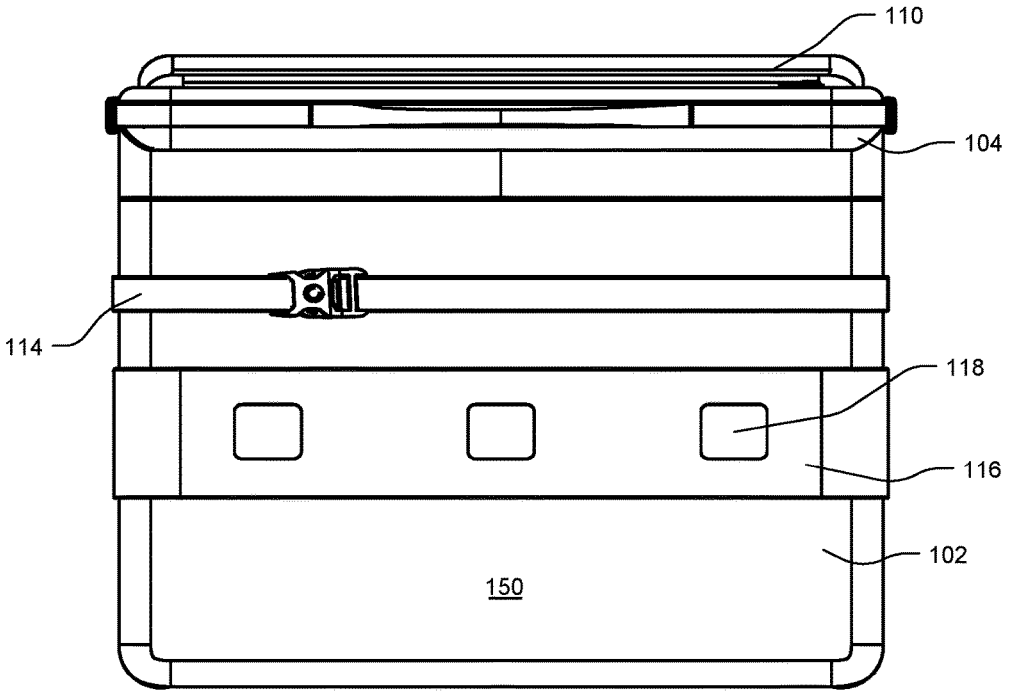
FIG. 1C is a top view of the baby chair of FIG. 1A, according to the embodiments herein.
Figure 1D:
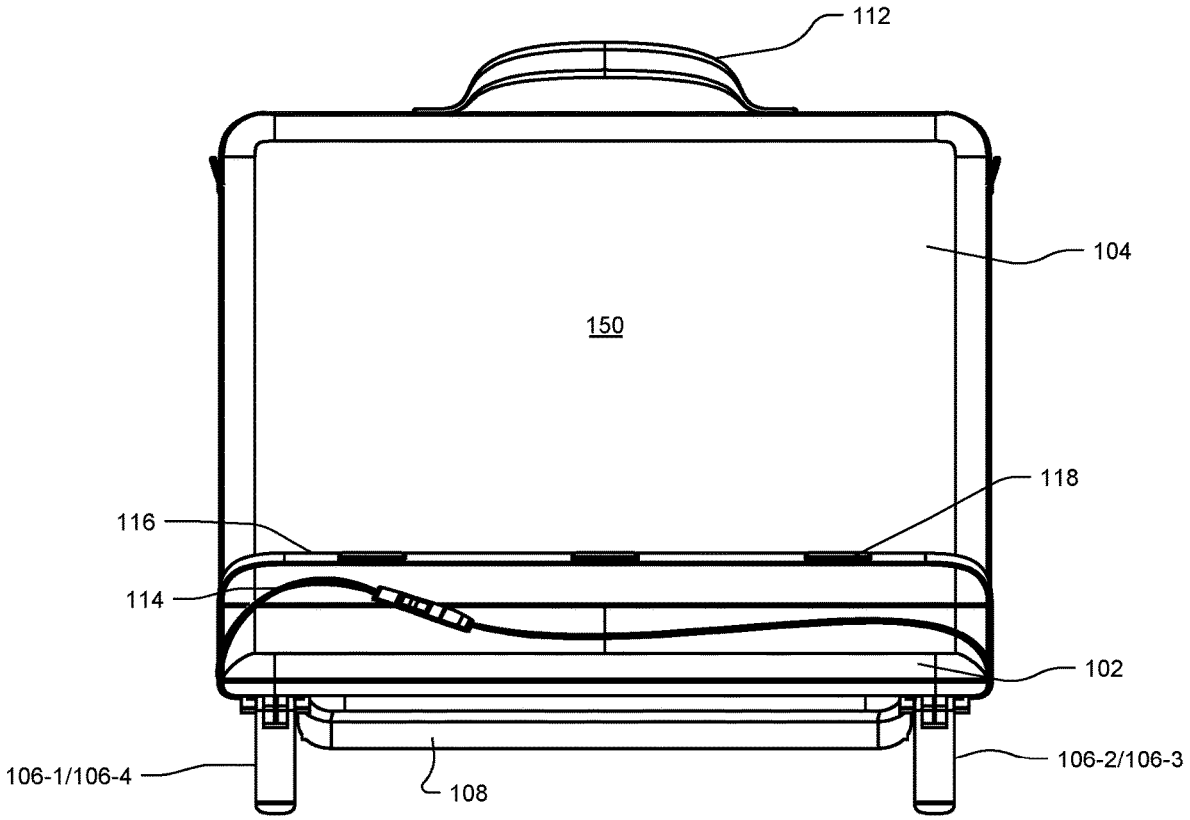
FIG. 1D is a front view of the baby chair of FIG. 1A, according to the embodiments herein.
Figure 2:
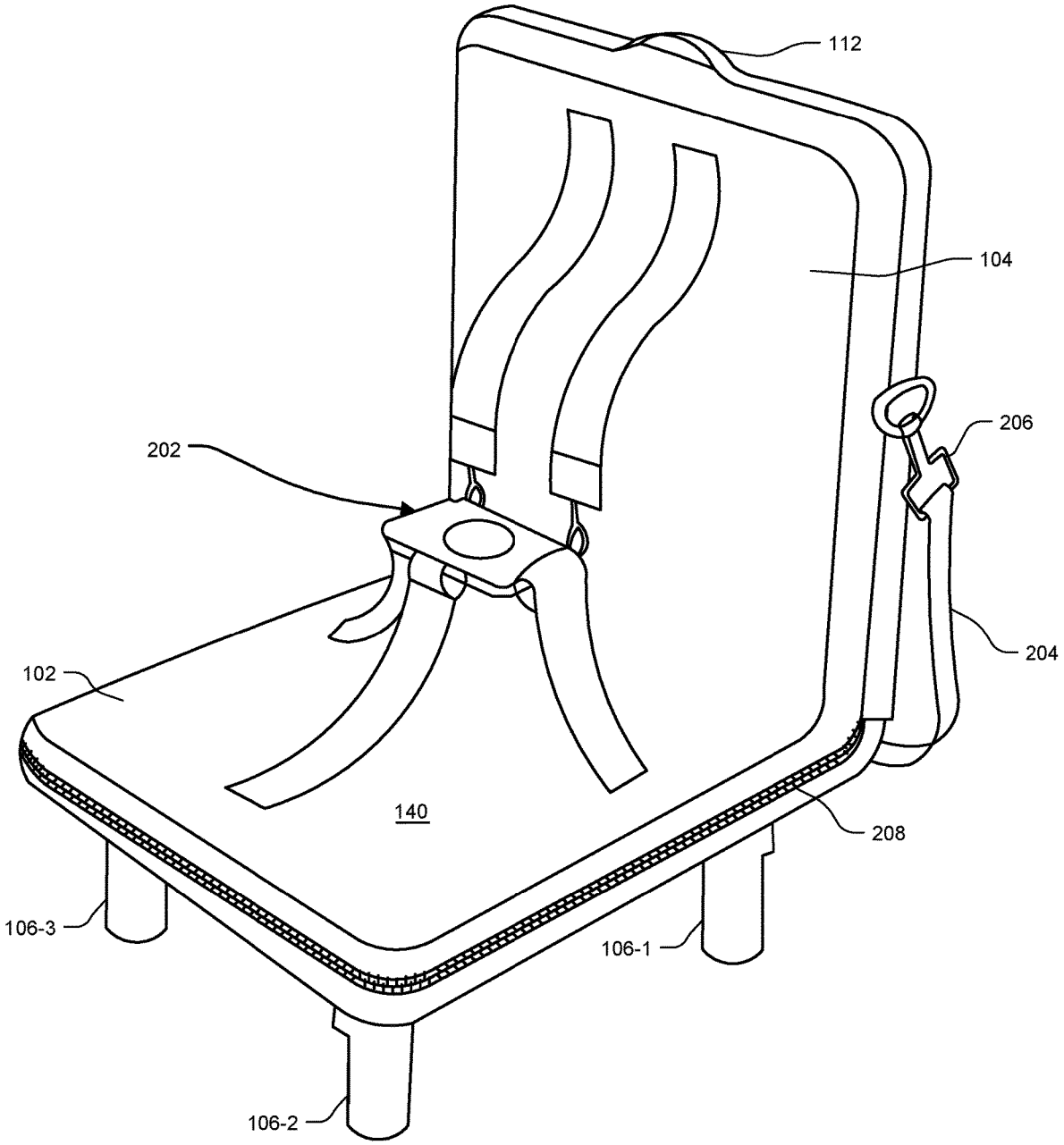
FIG. 2 is a perspective view illustrating a five-point safety harness and a shoulder strap fitted on a baby chair, according to the embodiments herein.

FIG. 2, with reference to FIGS. 1A through 1D, illustrates a second embodiment of the baby chair 100, wherein the baby chair 100 may include an adjustable five-point safety harness 202 in place of a two-point harness 114 (refer FIGS. 1A to 1D), and a shoulder slinging strap 204 that may be in addition to carrying handle 112. The shoulder slinging strap 204 may be detachably attached to the back portion 104 of the baby chair 100 through attachment mechanisms 206, such as snap rings, etc. so that the shoulder slinging strap 204 may be attached when required, and removed when not required.

In addition, the baby chair 100 may also include a detachable and washable cover 140 positioned over the front side of the upholstered bottom portion 102 and the back portion 104 and removable by clasping mechanisms 208 such as a zipper, button, seals, or clasp, etc. such as zipper 208 to enable removal for ease of washing and cleaning.

Figure 3C:
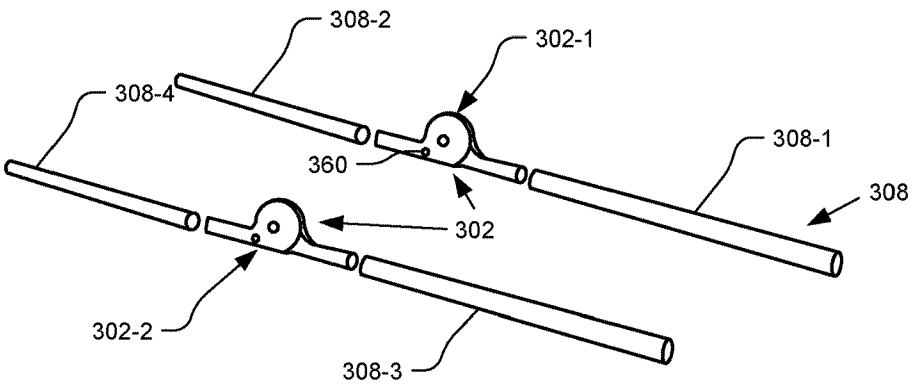
FIG. 3C is a perspective view illustrating a hinge mechanism aligned with tubes for a baby chair, according to the embodiments herein.
Figure 3A:
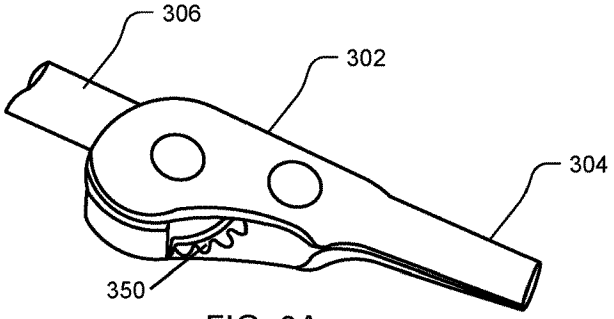
FIG. 3A is a perspective view illustrating a hinge mechanism for a baby chair showing the hinge in a fully open configuration, according to the embodiments herein.
Figure 3B:
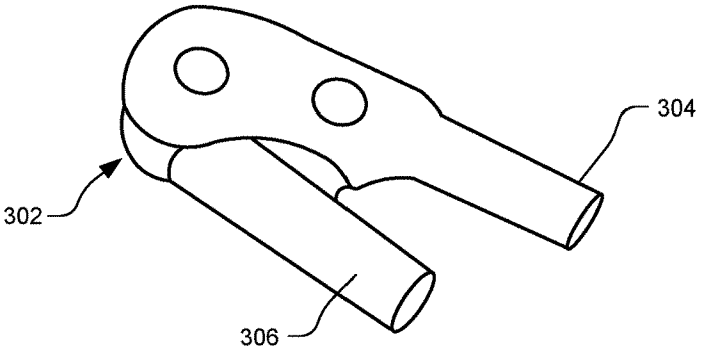
FIG. 3B is a perspective view illustrating a hinge mechanism for a baby chair showing the hinge in a closed configuration, according to the embodiments herein.

FIGS. 3A through 3F, with reference to FIGS. 1A through 2, illustrate hardware components of the baby chair 100. FIG. 3A illustrates an example of a hinge 302 with the rotatable tubular arm 306 extended, and FIG. 3B illustrates an example of the hinge 302 with the rotatable tubular arm 306 rotated inward and substantially parallel to the fixed tubular arm 304. Accordingly, as shown in FIG. 3C, the baby chair 100 may include a pair of identical folding hinges 302 comprising a right-side hinge 302-1 and a left-side hinge 302-2 (collectively referred to as hinge 302). Each folding hinge 302 includes a rotating tubular arm 306 and a fixed tubular arm 304 extending therefrom. The rotating tubular arm 306 may rotate such that it may be positioned substantially aligned with the fixed tubular arm 304 in an extended position or it may be positioned substantially parallel to the fixed tubular arm 304 in it fully constricted position. The two tubular arms 304, 306 are configured for connection to four identical tubes 308-1, 308-2, 308-3, 308-4 (collectively referred to as tubes 308). A pair of two plastic frames such as frame 310-1, 310-2 are connected to the tubes 308, wherein the tubes 308 and frames 310 form a supporting structure for the bottom portion 102 and back portion 104 of the baby chair 100. The hinges 302, tubes 308, and frames 310 may be made of aluminum, plastic, or other lightweight metal material.

Figure 3E:
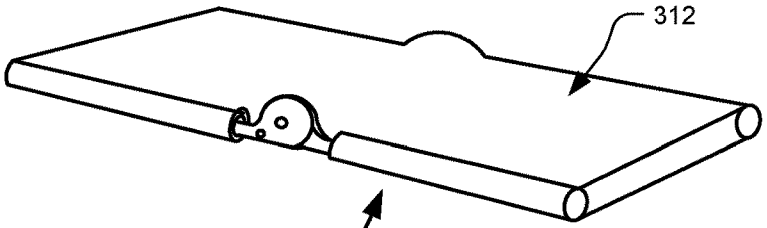
FIG. 3E is another perspective view illustrating a hinge mechanism aligned with tubes and frames for a baby chair, according to the embodiments herein.
Figure 3F:
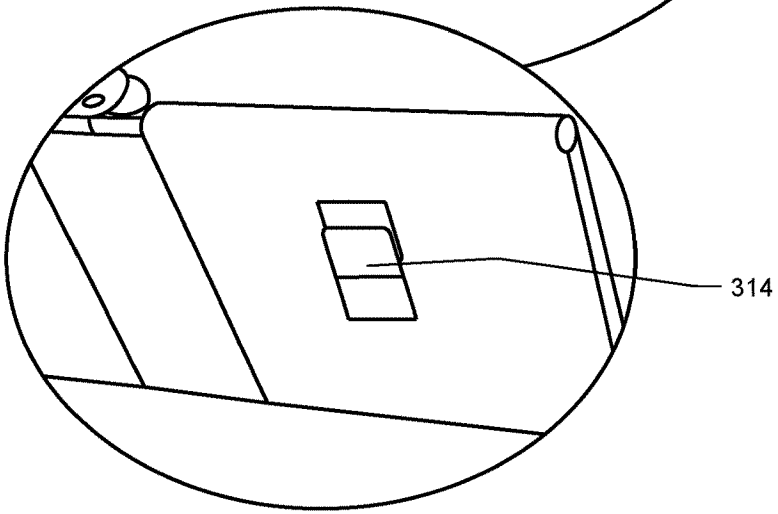
FIG. 3F is a magnified perspective view illustrating a hinge mechanism aligned with tubes and frames for a baby chair, according to the embodiments herein.
Figure 3D:
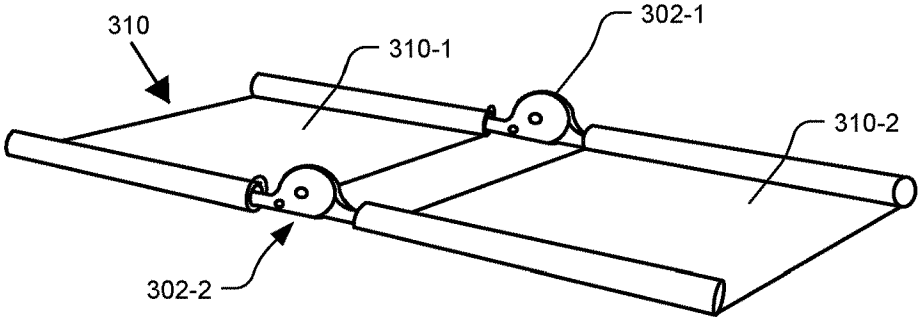
FIG. 3D is a perspective view illustrating a hinge mechanism aligned with tubes and frames for a baby chair, according to the embodiments herein.

Accordingly, the four tubes 308 are securely fixed to the tubular arms 304, 306 of the two folding hinges 302 as shown in FIG. 3C. As depicted in FIG. 3D, one of the two frames 310 such as frame 310-1 is fitted on the tubes 308 fixed to the two tubular arms, such as arms 304, of the pair of the two folding hinges 302 to form a structure for the bottom portion 102; and the second frame 310-2 is fitted on the remaining two tubes 308 fixed to the other two tubular arms; i.e. arm 306, of the pair of the folding hinges 302 to form a structure for the back portion 104 of the chair 100. The frames 310 provide a support to hold a cushion 312, as shown in FIG. 3E, that may be held on the two plastic frames 310 by upholstery 150 that also covers the bottom portion 102 and the back portion 104. The upholstery 150 may be held in position by an attachment mechanism (not shown) such as Velcro® fastener strips fed through slots 314, as shown in FIG. 3F.

In an embodiment, the folding hinges 302 are lockable hinges that may lock in different positions thereby allowing the back portion 104 to take different orientations relative to the bottom portion 102. For example, the hinges 302 may have internal stop mechanisms 350 actuated by push buttons 360 that click and retain in position at a plurality of predetermined angular positions and may utilize the push buttons 360 or other actuators to unlock the hinges to allow the chair 100 to move into another angular position. In particular, the back portion 104 may be configured in a position generally at 90° or greater than 90° relative to the bottom portion 102 to enable use of the baby chair 100 as a chair, a position generally parallel to the bottom portion 102 to enable its use as a bag (e.g., diaper bag), and a position generally at 180° to the bottom portion 102 for its use as a changing station/platform for changing diapers of a baby.

Figure 4A:
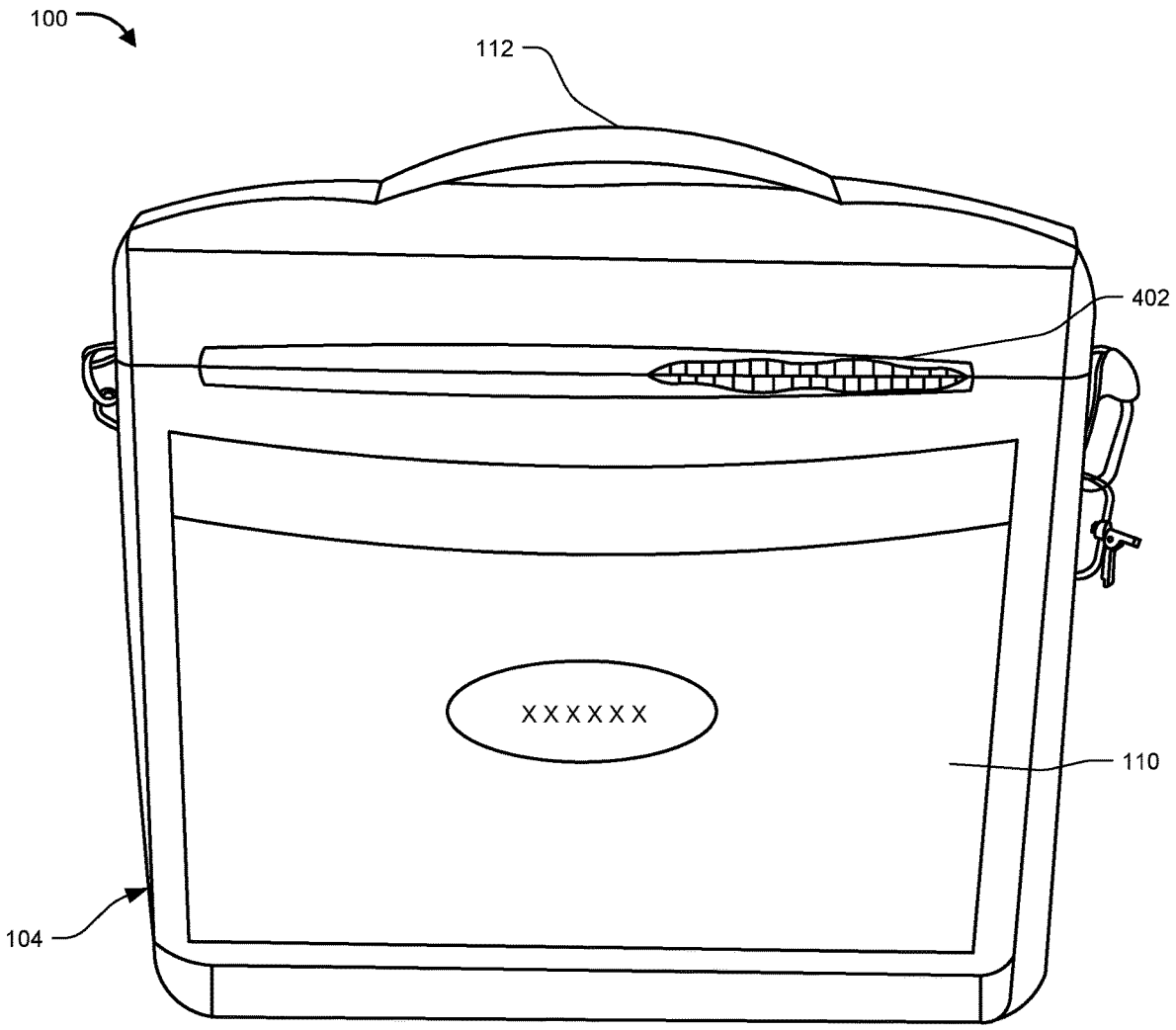
FIG. 4A is a front perspective view illustrating a baby chair folded in a bag, according to the embodiments herein.
Figure 4B:
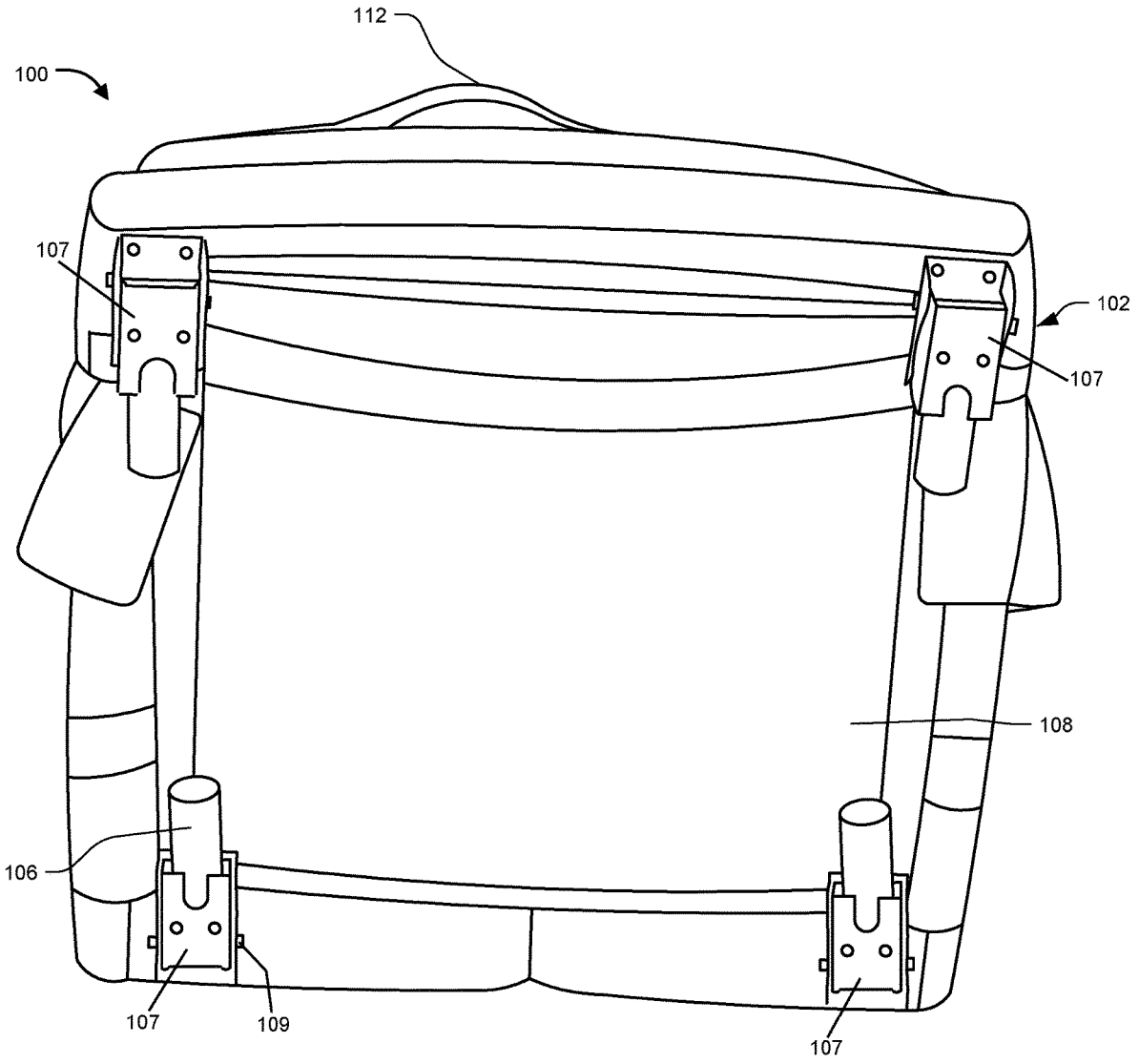
FIG. 4B is a rear perspective view illustrating a baby chair folded in a bag, according to the embodiments herein.
Figure 4C:
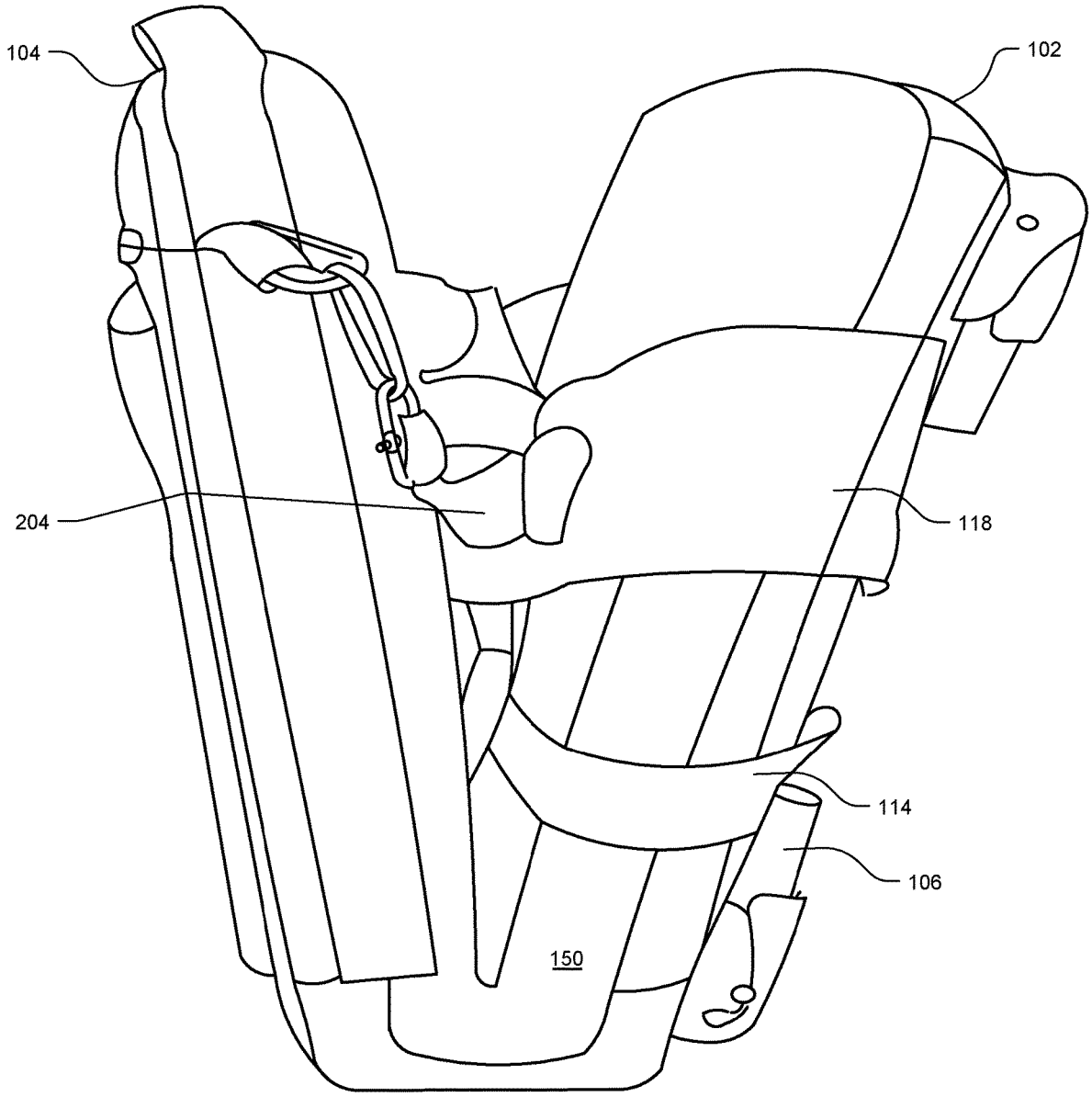
FIG. 4C is a side perspective view illustrating a baby chair folded in a bag, according to the embodiments herein.

Referring to FIGS. 4A through 4C, with reference to FIGS. 1A through 3F, where different views of the baby chair 100 in a folded configuration are shown, wherein the back portion 104 includes, as shown in FIG. 4A, an exterior storage compartment/pocket 110 that is configured over the upholstery 150 of the back portion 104, and one or more interior storage compartments/pockets 402. The interior storage compartments/pockets 402 may include a zipper, etc. to enable opening and closing of the storage compartments/pockets 402. In an example, there may be two or more interior storage compartments/pockets 402. In another example, only one of the interior storage compartments/pockets 402 includes a zipper while the other interior storage compartment/pocket 402 does not. The bottom portion 102 also may include an exterior storage compartment/pocket 108 as shown in FIG. 4B. Additionally, the legs 106 are shown in a folded configuration attached to the bottom portion 102 by brackets 107. Locking pins 109 may facilitate the rotation and locking of the legs 106 with respect to the brackets 107 and bottom portion 102 of the chair 100. FIG. 4C shows a side view of the baby chair 100 in a folded configuration with the back portion 104 folded over the bottom portion 102 through hinges 302 (not shown in FIG. 4C since they are covered by the upholstery 150).

Figure 5A:
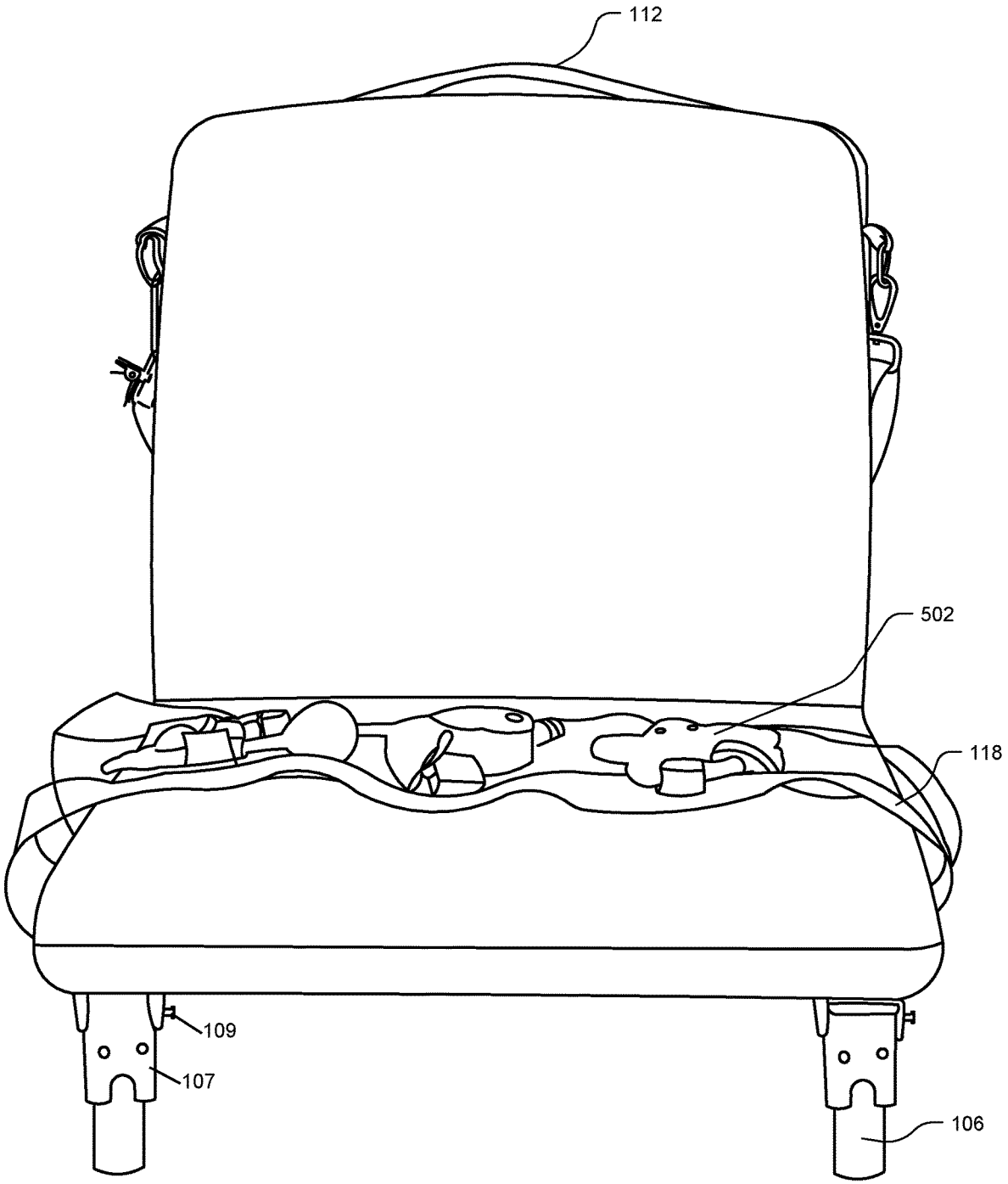
FIG. 5A is a front perspective view illustrating a baby chair in an unfolded configuration, according to the embodiments herein.
Figure 5B:
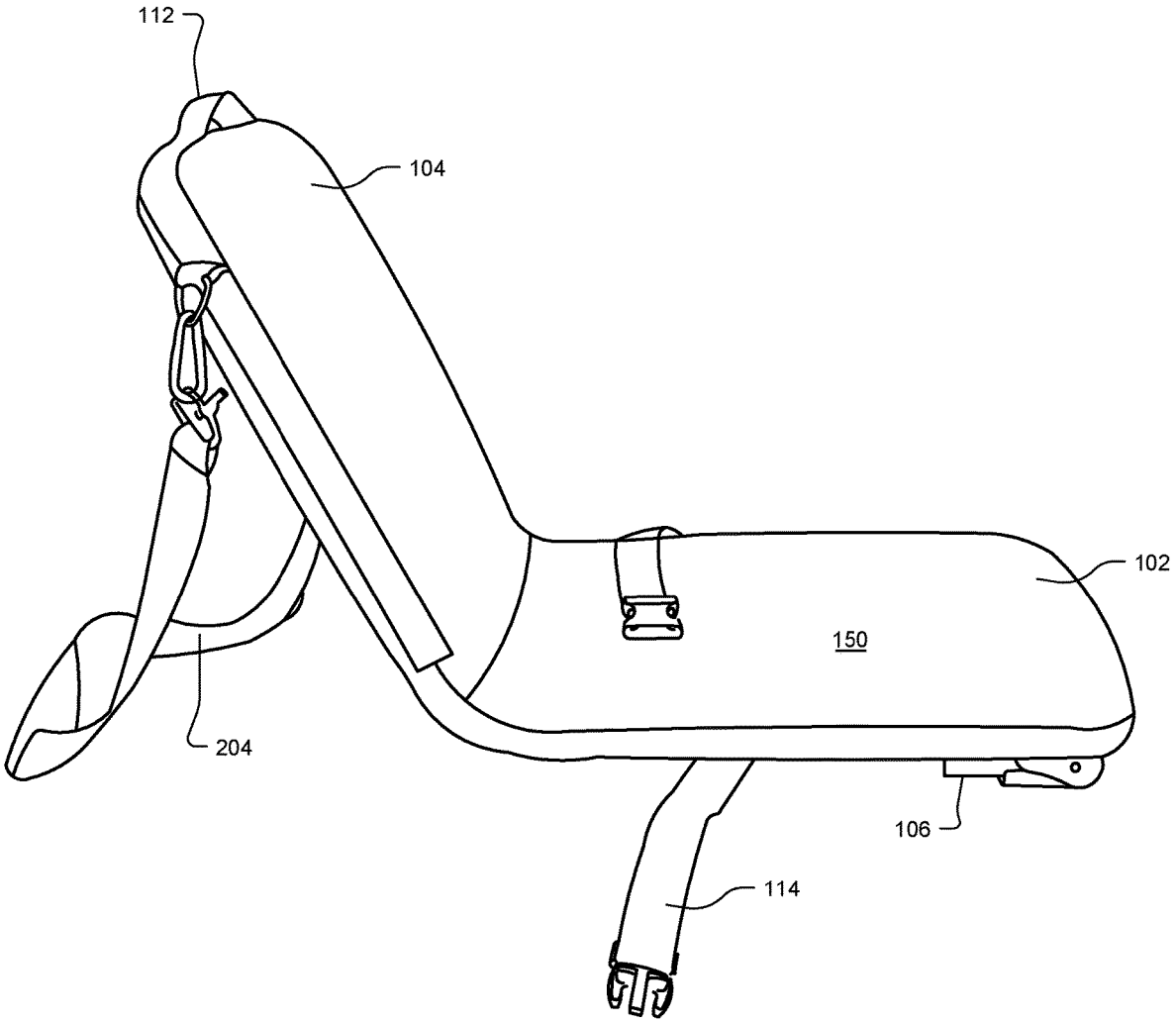
FIG. 5B is a side perspective view illustrating a baby chair in an unfolded configuration, according to the embodiments herein.

FIGS. 5A and 5B, with reference to FIGS. 1A through 4C, show front and side views respectively of the baby chair 100 in an unfolded configuration when the back portion 104 is at generally 90° or more with respect to the bottom portion 102 to enable seating of a baby in the chair 100. As shown in FIG. 5A, accessory attachment strap 118 may be used to fix attachments such as toys 502 for entertainment of the child. It may also be used to attach other accessories, as desired by a user. FIG. 5A further illustrates the legs 106 underneath the chair 100 in their unfolded configuration. As described above, the legs 106 may be attached to the bottom portion 102 of the chair 100 by brackets 107 and may be rotatable using pins 109.

Figure 6:
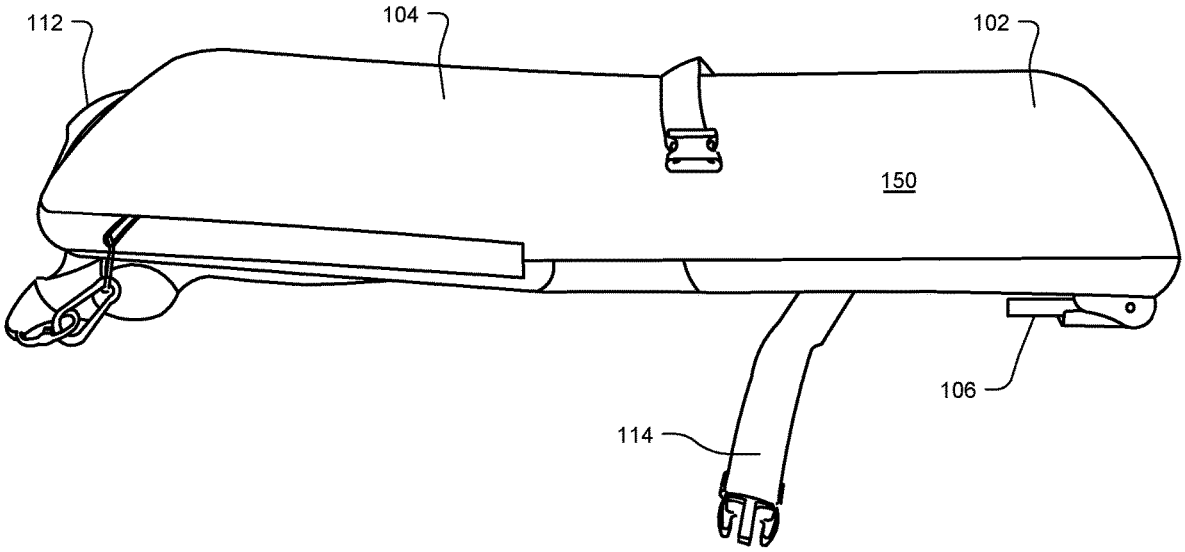
FIG. 6 is a side perspective view illustrating a baby chair in an unfolded configuration as a change station, according to the embodiments herein.

FIG. 6, with reference to FIGS. 1A through 5B, shows a perspective view of the baby chair 100 in its unfolded configuration, when the back portion 104 is in a position substantially at 180° with respect to the bottom portion 102. The baby chair 100, in this configuration may be used as change station/platform for changing diapers of a baby, for example. A separate changing pad (not shown) may be placed on the unfolded baby chair 100 to offer further protection of the upholstery material 150.

The baby chair 100 provided by the embodiments herein is configured as a multi-purpose chair that may be used as a chair 100 or as a changing station or as an entertainment station, and may be folded for and used as a diaper bag, for example. The chair 100 is lightweight manufactured with materials such as plastics and aluminum, and is easy and inexpensive to manufacture as having only a few parts and therefore affordable to customers as well.

The foregoing description of the specific embodiments will so fully reveal the general nature of the embodiments herein that others may, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein may be practiced with modification within the spirit and scope of the appended claims.

What is claimed is:

1. A foldable baby chair comprising:

a bottom portion comprising an upper surface and a lower surface;

a back portion;

at least one hinged joint coupled with a fixed tubular arm and a rotatable tubular arm for connecting the bottom portion to the back portion;

a set of exactly four brackets directly attached to four corners of the lower surface of the bottom portion, wherein the set of exactly four brackets do not contact the fixed tubular arm and the rotatable tubular arm; and a set of exactly four foldable legs fixed in the set of exactly four brackets, wherein the bottom portion and the back portion comprise a substantially similar and substantially rectangular shape and size, and wherein the hinged joint is to allow the back portion to be configured in different pre-defined positions in relation to the bottom portion, the predefined positions comprising at least one of a position substantially at 90° to the bottom portion to be configured in a upright chair position, a position wherein the back portion is substantially parallel to the bottom portion, and a position wherein the back portion is substantially 180° and planar to the bottom portion.

2. The baby chair of claim 1, wherein the set of exactly four foldable legs comprise any of plastic and aluminum.

3. The baby chair of claim 1, comprising upholstery material covering the bottom portion and the back portion, wherein the bottom portion and the back portion are cushioned.

4. The baby chair of claim 3, comprising at least one interior storage compartment on a backside of the back portion, wherein the at least one interior storage compartment is configured within the upholstery material covering the back portion.

5. The baby chair of claim 3, comprising at least one exterior storage compartment on a backside of the bottom portion and the back portion, wherein the at least one exterior storage compartment is configured over the upholstery material covering the bottom portion and the back portion.

6. The baby chair of claim 3, comprising a detachable cover over the upholstery material.

7. The baby chair of claim 1, comprising a carrying handle attached to the back portion.

8. The baby chair of claim 1, comprising an adjustable strap attached to the back portion.

9. The baby chair of claim 1, comprising a safety harness attached to any of the bottom portion and the back portion, wherein the safety harness comprises any of an adjustable lap strap and an adjustable five-point harness.

10. The baby chair of claim 1, comprising:

an accessory attachment strap coupled to the bottom portion; and a connection mechanism operatively connected to the accessory attachment strap.

11. A foldable baby chair comprising:

a bottom portion comprising an upper surface and a lower surface;

a back portion;

a pair of identical folding hinges comprising a left-side hinge and a right-side hinge, each of the folding hinges comprising a pair of tubular arms, wherein each pair of tubular arms comprises a fixed tubular arm and a rotatable tubular arm for connecting the bottom portion to the back portion;

a set of four identical tubes securely fixed to the pair of tubular arms of the pair of identical folding hinges;

a pair of plastic frames, wherein one of the plastic frames is fitted on two of the tubes fixed to the tubular arms to form a support structure for the bottom portion, and the second fitted on the remaining two tubes fixed to the other two tubular arms to form the back portion;

a cushion fixed on the pair of plastic frames;

a set of exactly four brackets directly attached to four corners of the lower surface of the bottom portion, wherein the set of exactly four brackets do not contact the pair of tubular arms, the set of four identical tubes, and the pair of plastic frames; and a set of exactly four foldable legs fixed in the set of exactly four brackets.

12. The baby chair of claim 11, wherein the set of exactly four foldable legs comprise any of plastic and aluminum.

13. The baby chair of claim 11, comprising upholstery material covering the bottom portion and the back portion.

14. The baby chair of claim 13, comprising at least two interior storage compartments on a backside of the back portion, wherein the at least two interior storage compartments are configured within the upholstery material covering the back portion.

15. The baby chair of claim 13, comprising at least one exterior storage compartment on a backside of the bottom portion and the back portion, wherein the at least one exterior storage compartment is configured over the upholstery material covering the bottom portion and the back portion.

16. The baby chair of claim 13, comprising a detachable cover over the upholstery material.

17. The baby chair of claim 11, comprising a carrying handle attached to the back portion.

18. The baby chair of claim 11, comprising an adjustable strap attached to the back portion.

19. The baby chair of claim 11, comprising a safety harness attached to any of the bottom portion and the back portion, wherein the safety harness comprises any of an adjustable lap strap and an adjustable five-point harness.

20. The baby chair of claim 11, comprising:

an accessory attachment strap coupled to the bottom portion; and a connection mechanism operatively connected to the accessory attachment strap.

* * * * *